United States Patent [19]

Mattson

[11] 4,358,942

[45] Nov. 16, 1982

[54] COMBINATION LOCK

[76] Inventor: Jerry L. Mattson, R.R. 3, Buffalo, Minn. 55313

[21] Appl. No.: 964,571

[22] Filed: Nov. 29, 1978

[51] Int. Cl.[3] ..... E05B 37/04

[52] U.S. Cl. ..... 70/303 A; 70/311; 70/321

[58] Field of Search ..... 70/302, 303 R, 303 A, 70/311, 321, 322, 309, DIG. 69

[56] References Cited

U.S. PATENT DOCUMENTS

| | | | |
|---|---|---|---|
| 1,022,268 | 4/1912 | Schechter | 70/303 R |
| 3,099,150 | 7/1963 | Check | 70/333 R |
| 3,196,643 | 7/1965 | Moss | 70/311 |
| 4,064,718 | 12/1977 | Cowen | 70/302 |
| 4,104,896 | 8/1978 | Hohn | 70/311 |
| 4,170,886 | 10/1979 | Cowen | 70/302 |

*Primary Examiner*—Robert L. Wolfe

*Attorney, Agent, or Firm*—Kinney, Lange, Braddock, Westman & Fairbairn

[57] ABSTRACT

A combination lock having a plurality of rotatable tumblers, a knob for positioning the tumblers, a bolt, a bolt cam for operating the bolt to unlock the lock upon proper positioning of the rotatable tumblers by proper clockwise and counter-clockwise rotation of the knob, and locking means for preventing said bolt cam from operating the bolt prior to proper positioning of the rotatable tumblers. According to a preferred embodiment the locking means includes a floating pin unconnected to any structure but moveable within the lock structure between positions preventing and permitting movement of the bolt cam and the knob is longitudinally moveable to engage the bolt cam for operation of the bolt.

11 Claims, 5 Drawing Figures

COMBINATION LOCK

BACKGROUND AND FIELD OF THE INVENTION

The invention relates in general to locks, in particular to combination locks, and specifically to such locks in which a dial drives a series of rotatable tumblers in one position and is moveable to another position for movement of the lock bolt cam.

Imperviousness to being picked is the essence of any lock. One method of picking a rotatable tumbler combination lock is to create a load on the tumblers. Many combination locks include a dial carrying out the clockwise and counter-clockwise rotations of the combination permutation and an external bolt cam lever for moving the bolt to unlock the lock. For such locks the combination permutation is carried out with the dial and the bolt cam lever manually operated to move the lock bolt. Other locks include an internal bolt cam biased (such as by a spring) to move into position for operating the lock bolt upon dialing of the combination permutation. So biased, the bolt cam applies a load to the lock tumblers. Such loaded tumbler locks are susceptible to picking by "feeling" the tumbler positions as the dial is turned, more specifically, by feeling the change in the load on the dial when a tumbler moves into its angular position for opening the lock.

Two approaches to frustrate picking a combination lock by the feel method are to include false gates in the tumblers and to hold the bolt cam away from the tumblers until after completion of the dialing permutation. The former is taught by the invention of Olaf Alfred Hage in his U.S. Pat. No. 2,104,516 which issued in January of 1938 and the latter by the invention of Peter J. Philips in his U.S. Pat. No. 3,981,167 which issued Sept. 21, 1976. The former seeks to make the load changes imperceptible and the latter to entirely eliminate any load change.

Combination locks are superior to keyed locks to the extent that keyed locks have a key hole which provides access to the interior of the lock and thereby makes the keyed locks susceptible to the lock picking technique in which the lock tumblers are set in lock opening positions by probing the tumblers with a mechanical pick inserted through the keyhole. However, generally in the past combination locks have been significantly bulkier in size than keyed locks. Because of their size, combination locks have not heretofore generally been used for the class of locks which has come to be known as vending machine locks, typically an Ace TM or Gem TM lock having a ¾ inch diameter cylinder with ⅝ inch across flats.

A general object of the invention is to provide a lock which is difficult to pick.

Another object of the invention is to provide a lock which minimizes if not totally eliminates load changes on the lock tumblers which can be felt during turning of the dial.

An additional object of the invention is a combination lock which is highly compact.

A further object of the invention is to provide a lock which is inexpensive to manufacture and easy to assemble.

BRIEF DESCRIPTION OF THE INVENTION

Briefly, the invention comprises a combination lock which is small enough to replace standard keyed vending machine ¾ inch (1.90 cm.) diameter, ⅝ inch (1.59 cm.) across flats. According to the preferred embodiment a free floating bolt cam locking means oriented parallel to the lock rotating tumbler axis of rotation and a dial knob longitudinally positionable along the same axis provide a combination lock only slightly larger in diameter than the lock rotating tumblers. And, the lock is highly pick resistant by the feel method because the free floating locking means provides unbiased locking of the bolt cam.

According to a preferred embodiment of the invention the bolt cam is a cylinder mounted in a housing and having a center spindle carrying the rotatable tumblers. The tumblers have conventional gates in their outer peripheral edges. The housing and cylinder respectively have a groove and slot complimentary to each other for accepting a free floating pin when the lock is in an unlocked condition. Upon alignment of the rotatable tumbler gates to form an unlocking cage in registration with the cylinder slot and housing groove, the free floating pin releases the cylinder for turning in the housing by passing out of the groove and into the unlocking cage, the pin otherwise residing partially in the cylinder slot and partially in the housing groove to prevent movement of the bolt cam cylinder. Turning of the cylinder when the free floating pin is in the unlocking cage out of contact with the housing is by direct engagement of the cylinder bolt cam by the dial knob. The dial knob is positionable longitudinally between the position of engagement with the bolt cam and a position for driving the rotatable tumblers.

DETAILED DESCRIPTION OF THE INVENTION

Figure 1:
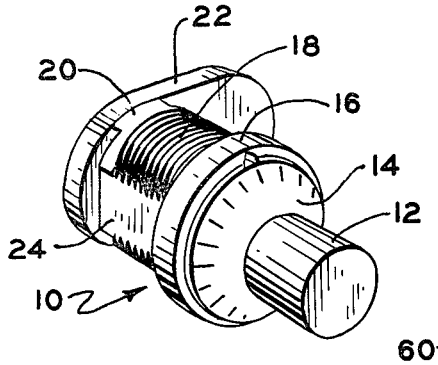
FIG. 1 is a perspective view of a preferred embodiment of a combination lock according to the present invention.

A perspective view of a preferred embodiment of a combination lock according to the present invention is shown generally as 10 in FIG. 1, a perspective view. Lock 10 includes a dial knob 12 carrying angular position indicia 14 thereon; a housing 16 including a threaded barrel portion 18 and a bolt stop portion 20; and, a bolt 22. Barrel portion 18 includes a pair of flats one of which is shown as 24 and the other of which is hidden from view. Bolt 22 of the illustrated preferred embodiment includes a portion (not shown) which cooperates with stop 20 to limit rotation of the bolt. The bolt angular rotation depends upon the particular application, may be any amount from a few to three hundred and sixty degrees, and is independent of the present invention.

Figure 2:
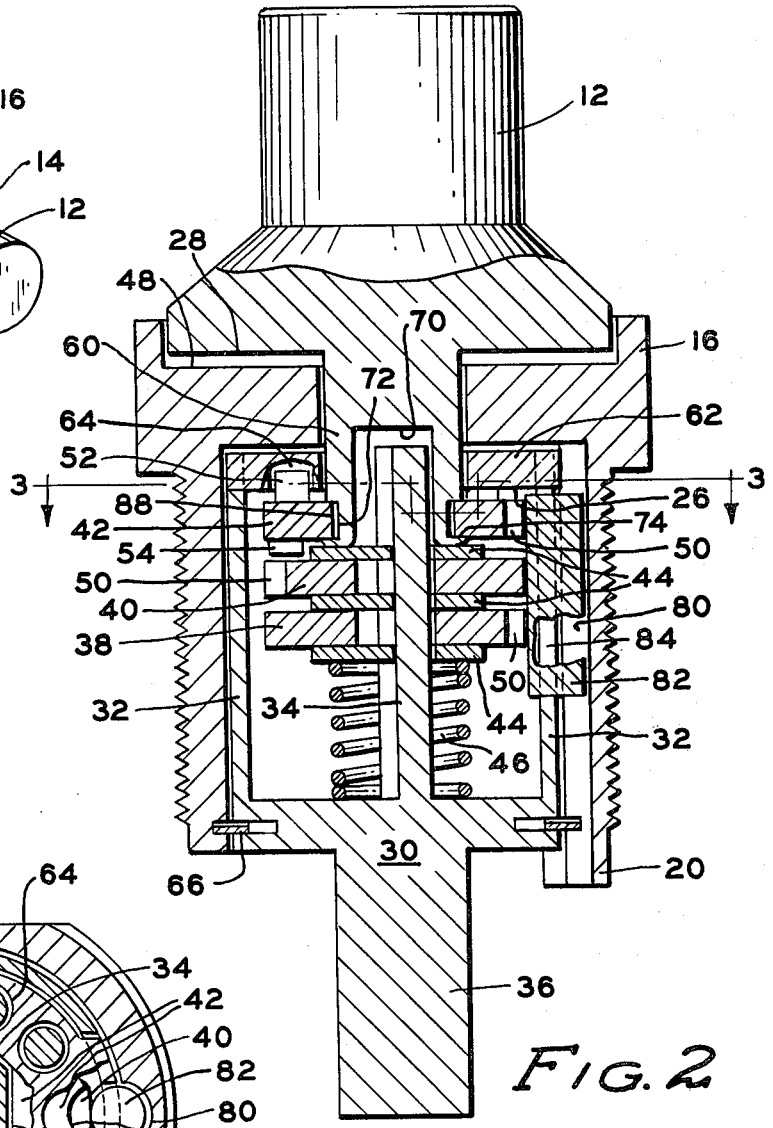
FIG. 2 is essentially a longitudinal sectional view of the lock of FIG. 1 taken through the center of the lock except for the endmost part of the dial knob and includes cutaway portions.

FIG. 2 is essentially a longitudinal sectional view of the lock 10 of FIG. 1 exclusive of the bolt 22 and includes cutaway portions. Visible in the sectional view of FIG. 2 are a cylindrical bolt cam 30 having an outer wall 32, center spindle 34, and a bolt engaging hub 36; and, a tumbler assembly comprising a plurality of rotatable tumblers 38, 40, and 42 separated by spacers 44 and longitudinally positioned on spindle 34 by a spring 46. In FIG. 2, the tumbler assembly and knob dial 10 are shown in a state of transition between the dial knob 10 two stable positions of fully out and fully in. In the fully out position, rotatable tumbler 42 is in contact with surface 26 of the cylindrical bolt cam 30. In the fully in position, surface 28 of dial knob 12 is in contact with surface 48 of housing 16. This position was arbitrarily chosen. Each of rotatable tumblers 38, 40, and 42 include a gate 50 in its outer peripheral edge. In the Figure gate 50 of tumblers 42 and 38 are shown in a position of alignment and of tumbler 40 in a position 180 degrees out of alignment. Each rotatable tumbler includes at least one upper nib 52 and tumblers 40 and 42 must include a lower nib 54 only one of which is visible. Rotatable tumbler 42 differs from the other tumblers in that it includes a plurality of upper nibs 52 and is fixedly attached to the dial knob 12 inner shaft 60. The plurality of upper nibs 52 of tumbler 42 are for engagement in mating apertures of a coupling plate 62 of cylindrical bolt cam 30 which has been partially cut away to expose an aperture 64. Cylindrical bolt cam 30 and housing 16 are rotatably joined together with a loose fitting retaining ring 66 seated in grooves provided in the cam and housing for that purpose. Dial knob 12 inner shaft 60 includes a bore 70 for accepting spindle 34, includes flats 72 recessed into the shaft for interlocking with and vertically positioning rotatable tumbler 42, and includes a crimp 74 on the end of the shaft for permanently affixing tumbler 42 to the shaft. A groove 80 in housing 16 together with a free floating pin 82 provide cam bolt locking means. Free floating pin 82 is shown in a locking position partially in a slot 84 in the wall 32 of bolt cam 30 and partially in groove 80 of housing 16. The manner in which pin 82 acts to lock the bolt cam 30 wall 32 from rotation within housing 16 is more apparent in FIG. 3.

Figure 3:
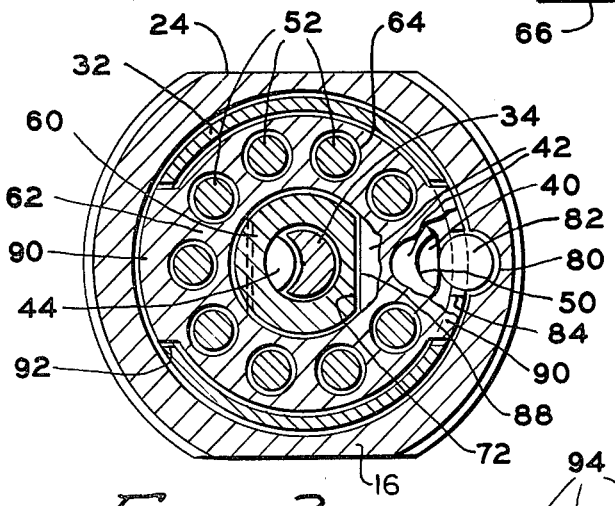
FIG. 3 is a transverse sectional view taken along line 3—3 of FIG. 2; and, FIGS. 4 and 5 are edge and top plan views of the rotatable tumbler of the lock which is permanently connected to the shaft of the lock dial knob.
Figure 4:
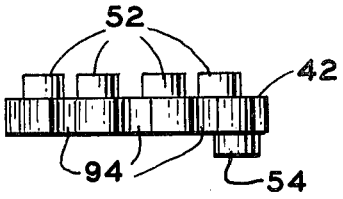
Figure 5:
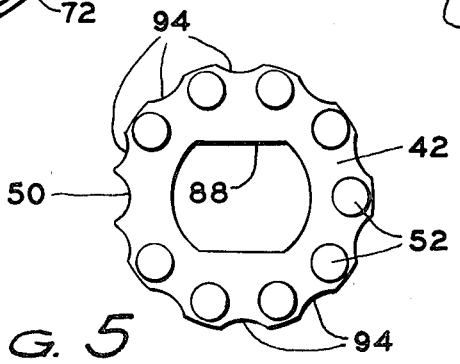

FIG. 3 is a sectional view taken along line 3—3 of FIG. 2 at two elevations. The view is partially cut away to provide top views of pin 82, slot 84, gate 50 of rotatable tumbler 42, and the manner in which the unaligned tumbler 40 outer peripheral edge holds pin 82 partially in slot 84 and partially in groove 80. The lower elevation of the section provides a view of a flat 72 of dial knob 12 inner shaft 60 and of a mating flat 88 of rotatable tumbler 42. Coupling plate 62 is shown to have ears 90 which seat in recesses 92 in the end of cylindrical bolt cam 30 wall 32. Also in view in FIG. 3 is the convex inner radius portion of a spacer 44 which mates with the concave radiused part of spindle 34. Edge and top plan views of rotatable tumbler 42 are shown in FIGS. 4 and 5. The latter Figure in particular shows false gates 94 around the tumbler outer peripheral edge.

All spacers 44 are identical. Rotatable tumblers 38 and 40 are identical for reasons of manufacturing economy although there is no need for a lower nib 54 on tumbler 38. Tumbler 42 differs from tumblers 38 and 40 in that it includes flats 88 whereas tumblers 38 and 40 have a circular center; in that it includes a plurality of upper nibs for engagement in the coupling plate apertures 64; and, in that it is slightly larger in diameter. (This use of an enlarged diameter drive tumbler is another known device for holding the bolt cam out of contact with the remaining tumblers to frustrate the feel method of picking the lock.) Groove 80, pin 82 and rotatable tumbler gate 50 parameters are determinable using the formulas of force vector diagrams and can also be determined from keyed locks which incorporate similar features. These keyed locks are manufactfured by the Abloy Company, a Division of Wartsila, Inc. 5603 W. Howard Street, Niles, Ill. 60648. Construction of the lock is by well known, state of the art techniques using conventional lock grade materials. Spacers 44, coupling plate 62, and tumblers 38, 40 and 42 are manufactured by an uncomplicated conventional stamping process. Cylindrical bolt cam 30, housing 16, and dial knob 12 are screw machined, milled and drilled in a conventional, well known, straightforward manner. Pin 82, retaining ring 66 and spring 46 are uncritical, inexpensive, off-the-shelf items. These and the aforementioned manufacturing economies together with ease of assembly as hereinafter described provide an inexpensive combination lock. The unbiased cam and free-floating locking means eliminate cam positioning structure to contribute to the lock economies and also streamline and miniaturize the lock. Assembly of a lock consists of inserting a dial knob 12 into a housing 16. A coupling plate 62 is placed over the end of shaft 60 followed by a rotatable tumbler 42 after which the end of the shaft 60 is crimped to produce crimp 74. A spring 46 followed by spacers 44 and rotatable tumblers 38 and 40 in the proper sequence are placed over spindle 34 of a cylindrical cam bolt 30. A pin 82 is inserted into the cylindrical bolt cam slot 84 and the pin and bolt cam inserted into housing 16 with the pin in groove 80 and a retaining ring 66 pinched to seat entirely in its bolt cam 30 groove. If necessary, dial knob 12 is rotated to position coupling plate 62 for proper seating in recesses 92 of the cylindrical bolt cam 30. The assembly is secured with the retaining ring 66 when the ring 66 expands and pops into its housing 16 groove to partially reside in the housing groove and partially reside in the bolt cam groove upon the cylindrical bolt cam being fully inserted into the housing. The illustrated embodiment is a permanent assembly. No provision has been made for access to the retainer spring to permit removal.

Operation of a locked lock consists of pushing in dial knob 10 to disengage the upper nibs 52 from the coupling plate apertures 64. So pushed in dial knob 12 is in a position for rotatably driving the rotatable tumblers. Rotatable tumbler 42 is directly driven by dial knob 12. Lower nibs 54 and upper nibs 52 between rotatable tumbler 42 and 40 and between tumblers 40 and 42 cooperate whereby tumbler 42 drives tumbler 40 and tumbler 40 in turn drives tumbler 38 in a well known manner. Upon clockwise and counter-clockwise rotation of dial knob 12 according to the lock permutation sequence, all of gates 50 are aligned in registration with slot 84 and groove 80 to form an unlocking cage for accepting pin 82. Release of dial knob 12 allows spring 46 to expand and force the dial knob outwards and engage the upper nibs 52 carried on rotatable tumbler 42 in the coupling plate 62 apertures 64. With the dial knob 12 again in the bolt cam moving position, rotation of the knob urges pin 82 into the unlocking cage of the gates 50 with pin 82 entirely out of contact of groove 80 and the inner wall of housing 16 thereby freeing cylindrical bolt cam 30 to turn in the housing.

The foregoing preferred embodiment has been given by way of illustration and not limitation. Various modifications and variations of the concepts disclosed with reference to the preferred embodiment are deemed within the scope of the invention. For example, again by way of illustration and not limitation, a lock embodying the principles of the present invention could be constructed by substituting concentric cylindrical tumblers for the disc tumblers, cylindrical bolt cam, and grooved barrel. The cylindrical tumblers would nest coaxially, would include appropriate inner and outer nibs for positioning the cylinders, and would include an unlocking cage slot in the cylinder side wall. One cylinder would be directly driven by the lock dial knob. The cylinder ends would seat in concentric races in the lock dial base knob and in a lock housing. The housing would include a rotatable pedestal extending midway through the cylinders towards the dial knob along the cylinder axis and would include a female coupler on its interior end. The dial knob would be longitudinally positionable and have a male end for mating engagement with the rotatable pedestal female coupler. Entry to the rotatable pedestal female coupler would normally (with the lock in a locked condition) be blocked by a free floating locking bar. Engagement of the dial knob into the rotatable pedestal could only be accomplished when the cylinders were properly positioned to form an unlocking cage for accepting the free floating locking bar. The dial knob end would force the locking bar into the unlocking cage. The locking bar could be not unlike a semi-circular section of rod normally residing in a circumferential groove extending partially around the pedestal shaft. The lock bolt would be affixed to turn with the pedestal shaft.

The true scope of the present invention is as set forth in the following claims.

What is claimed is:

1. A combination lock comprising, in combination:

(A) a bolt moveable between a locked and an unlocked position;

(B) a bolt cam for moving said bolt between said locked and unlocked positions;

(C) a plurality of tumblers each having a gate and which gates are collectively alignable to form an unlocking cage and when so aligned correspond to an open position of the lock;

(D) knob means for dialing the lock combination to align said gates and for operating said bolt cam to open said lock, said knob being longitudinally positionable along its axis of rotation between one position for a bolt cam operating mode of movement and another position for a tumbler driving mode of movement; and (E) free floating locking means for preventing said bolt cam from moving said bolt prior to alignment of said gates having formed an unlocking cage but cooperating with said unlocking cage formed by alignment of said gates to release said bolt cam for movement of said bolt to unlock the lock upon said knob having been initially rotated through the proper sequence of clockwise and counter-clockwise rotations and thereafter moved to operate said bolt cam which in turn moves said bolt to said unlocked position.

2. A lock according to claim 1 wherein said tumblers comprise a series of coaxially rotatable tumblers.

3. A lock according to claim 1 wherein said tumblers comprise a series of coaxially rotatable discs.

4. A lock according to claim 3 wherein each said gate is in a peripheral edge of a said disc.

5. A lock according to claim 4 wherein each said peripheral edge is an outer edge.

6. A lock according to claim 5 wherein said locking means comprises a free floating pin and a housing and said bolt cam comprises a cylinder mounted for rotation within said housing; said housing includes an elongate groove extending longitudinally relative to said cylinder axis of rotation, said groove having a length which totally and a depth which partially accepts said free floating pin; said bolt cam cylinder includes a slot complimentary to said housing groove for partially accepting said free floating pin when said lock is in a locked condition and in registration with said rotatable tumbler disc gates for accepting said free floating pin partially in said slot and partially in a said unlocking cage formed by said gates to permit rotation of said cylinder when said lock is in an unlocked condition whereby when the lock is in an unlocked condition the free floating pin resides partially in said housing groove and partially in said bolt cam cylinder slot to prevent rotation of said bolt cam cylinder but when said lock is in an unlocked condition turning of the knob in its bolt cam mode of movement urges said free floating pin out of said housing groove and partially into a said unlocking cage formed by the correct positioning of said rotatable tumbler discs to release said cylinder for rotation within said housing and operation as a bolt cam for unlocking the lock.

7. A lock according to claim 6 wherein all except an inner end one of which rotatable tumbler discs include an upper nib and a lower nib extending longitudinally from the disc surfaces towards and away, respectively, from said knob and which nibs of adjacent tumblers are engageable with each other for rotational driving of the rotatable tumblers; said inner end rotatable tumbler is the furthest of all the tumblers from said knob; and said knob driveably engages the rotatable tumbler closest to it whereby proper sequential clockwise and counter-clockwise rotation of said knob aligns said rotatable tumbler disc gates to form a said unlocking cage.

8. A lock according to claim 7 wherein said knob is fixedly coupled with a said rotatable tumbler; said bolt cam cylinder includes means for engaging a nib of said fixedly coupled rotatable tumbler; and said knob is longitudinally positionable between a tumbler driving position at which said fixedly coupled rotatable tumbler is disengaged from said bolt cam cylinder nib engaging means and a bolt cam positioning position at which said fixedly coupled tumbler is engaged by said bolt cam cylinder.

9. A lock according to claim 8 further comprising knob biasing means for resiliently holding said knob in one of said positions.

10. A lock according to claim 9 wherein said biasing means comprises a spring for positioning all rotatable tumbler discs with their nibs in interengaging relationships and for positioning said fixedly coupled rotatable tumbler disc in engagement with said bolt cam cylinder nib engagement means.

11. A lock according to claim 1 for use in a part-cylindrical D-type opening, said lock including a housing having a barrel portion which is part-cylindrical and part flat in cross section, the barrel portion being of configuration to fit snugly inside of and to mate with said D-opening, said housing encompassing all elements of said lock except part of said knob means, part of said bolt cam and said bolt.

* * * * *